US005826655A

United States Patent [19]

Snow et al.

[11] Patent Number: 5,826,655

[45] Date of Patent: Oct. 27, 1998

[54] METHOD FOR ENHANCED RECOVERY OF VISCOUS OIL DEPOSITS

[75] Inventors: Dennis M. Snow, Parker, Colo.; Tim A. O'Connell, Bakersfield, Calif.

[73] Assignee: Texaco Inc, White Plains, N.Y.

[21] Appl. No.: 637,311

[22] Filed: Apr. 25, 1996

[51] Int. Cl.[6] ..... E21B 43/24

[52] U.S. Cl. ..... 166/272.3; 166/50; 166/272.7; 166/303

[58] Field of Search ..... 166/272.3, 303, 166/50, 272.7

[56] References Cited

U.S. PATENT DOCUMENTS

| | | | |
|---|---|---|---|
| 3,960,213 | 6/1976 | Striegler et al. | 166/272.3 |
| 4,046,199 | 9/1977 | Tafoya | 166/303 |
| 4,099,570 | 7/1978 | Vandergrift | 166/303 |
| 4,248,302 | 2/1981 | Churchman | 166/50 X |
| 4,466,485 | 8/1984 | Shu | 166/272.3 |
| 4,832,122 | 5/1989 | Corey et al. | 166/272.7 |
| 5,065,821 | 11/1991 | Huang et al. | 166/303 |
| 5,141,054 | 8/1992 | Alameddine et al. | 166/303 |
| 5,145,003 | 9/1992 | Duerksen | 166/272 |
| 5,211,240 | 5/1993 | Gadelle et al. | 166/303 |
| 5,607,018 | 3/1997 | Schuh | 166/303 |
| 5,626,193 | 5/1997 | Nzekwu et al. | 166/303 |

*Primary Examiner*—Hoang C. Dang
*Attorney, Agent, or Firm*—Henry H. Gibson; William J. Beard

[57] ABSTRACT

Methods and apparatus for enhanced and improved viscous oil recovery are disclosed. A horizontal well is drilled through the viscous oil formation. A specially designed steam stinger is used to inject steam substantially uniformly into the entire horizontal extent of the well borehole without direct steam impingement on the production liner in the viscous oil formation. Heat from the steam mobilizes and lowers the viscosity of the heavy crude wherein the crude is then produced to the surface via conventional lift arrangements.

7 Claims, 5 Drawing Sheets

METHOD FOR ENHANCED RECOVERY OF VISCOUS OIL DEPOSITS

FIELD OF THE INVENTION

This invention relates to oil field production apparatus and techniques, and more particularly, to such apparatus and techniques for use in the production of extremely viscous crude oil.

BACKGROUND OF INVENTION

It has been known to produce viscous crude oils in reservoirs by drilling vertical wells into the producing zone and then injecting steam into the viscous crude to increase its mobility and reduce its viscosity. This steam injection has been done in several different ways. In one technique producing wells in the reservoir can be cyclically steamed by injecting steam down a vertical well into the production zone for a relatively short period of time. The well is then placed on production for a relatively longer period of time and this cycle repeated until the production becomes unprofitable.

Another technique which has been used to produce viscous crude reservoirs is to drill vertical wells in a geometrical pattern into the production zone and to designate certain of these wells as injection wells. Steam is then continuously injected into the production zone via the injection wells in an attempt to drive the steam and its heat to move the viscous crude oil to the other vertical producing wells in the geometrical array.

In the initial development of a reservoir of viscous crude these described methods have worked well. Over time however, the steam tends to congregate in the upper portion of the producing zone. This, of course, does not cause heating of the viscous crude in the lower portion of the producing zone. The heavy crude saturated lower portion of the producing zone is not depleted as the high viscosity of the crude prevents its easy migration to the well bores of the producing wells. Thus large quantities of potentially producible crude oil can become otherwise not recoverable.

BRIEF DESCRIPTION OF THE INVENTION

In order to more efficiently heat and render mobile heavy viscous crude oils throughout a thick production zone a horizontally oriented well is drilled into the production zone. Special apparatus according to the concepts of the invention is then used to deliver steam uniformly horizontally distributed to the production zone along the entire length of the horizontal portion of the well in the producing zone. This type of delivery can prevent steam migration into the underlying water zone or into the upper desaturated portion of the reservoir. Also by delivering the steam uniformly along the entire horizontal portion of the producing zone penetrated by the horizontal portion of the well, any potential damage to a production liner in this horizontal bore is reduced. The special apparatus comprises a horizontal steam stinger made up of perforated production tubing which is inserted into the horizontal production zone liner. The perforations in the stinger are sized and spaced to deliver a particular amount of steam equally along its length at a predetermined pressure. The stinger is provided with a sacrificial impingement strap at each perforation to prevent direct impingement of live steam delivered by the stinger onto the production liner. These straps also assist in distributing the steam around the circumference of the wellbore prior to its entry through the liner into the production zone.

The apparatus and techniques of the invention are best understood by reference to the following detailed description thereof, when taken in conjunction with the accompanying drawings, in which:

DETAILED DESCRIPTION OF THE INVENTION

Figure 1:
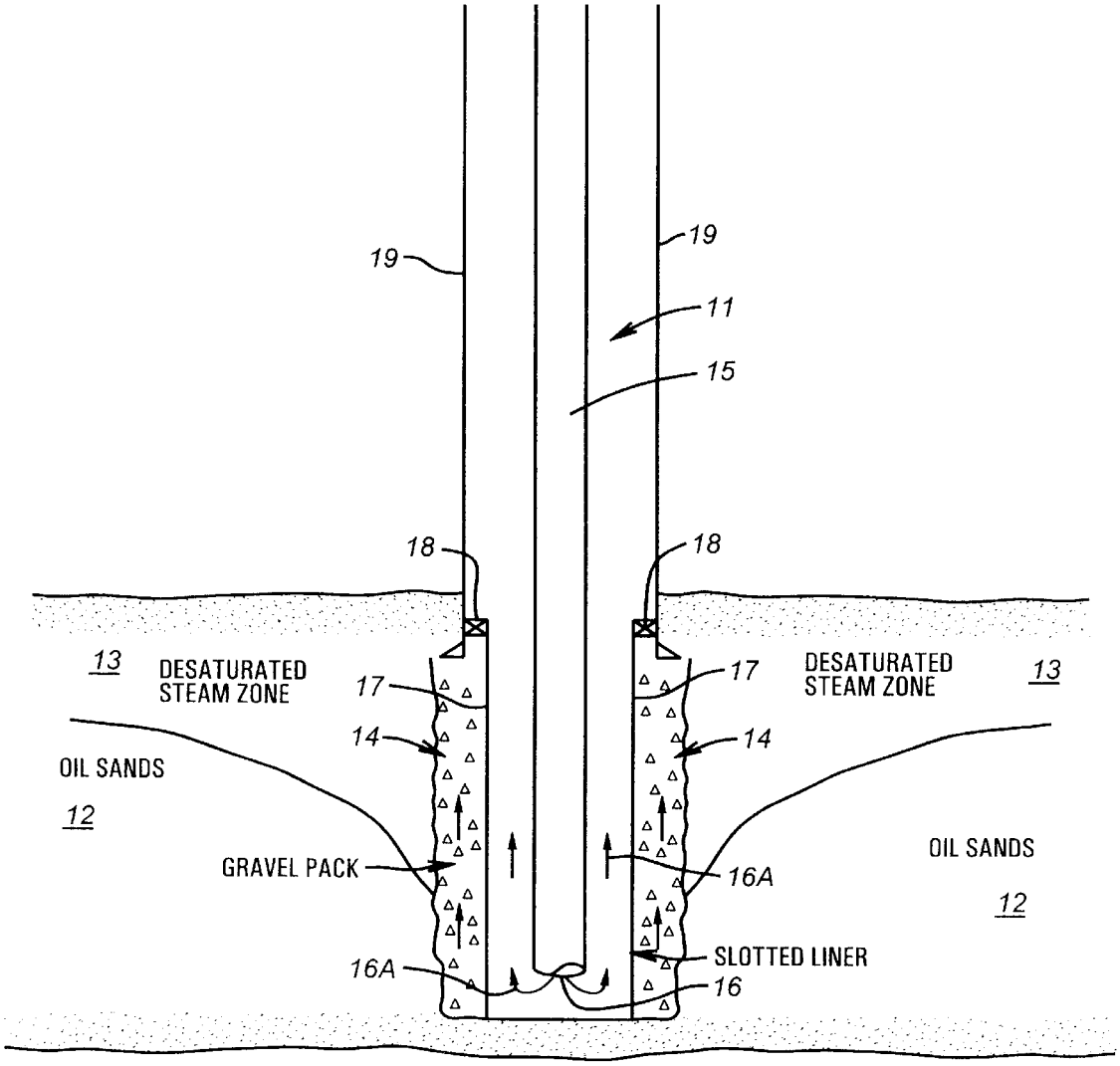
(PRIOR ART) FIG.1
FIG. 1 is a schematic diagram of prior art technique showing in cross section a heavy crude production zone penetrated by a vertical well using steam to heat the crude oil.

Referring initially to FIG. 1 a prior art heavy crude oil production zone penetrated by a vertical well is shown schematically. A well borehole 11 (vertical) penetrates producing oil sands 12 which are saturated with high viscosity heavy crude oil. The completion technique uses a slotted liner 17 below cemented casing 19 which extends to the surface. A lead seal 18 isolates the producing sand 12 from vertical communication. A gravel pack 14 outside slotted liner 17 keeps loosely compacted formation sand 12 from gathering around the liner 17 slots and clogging the line slots. Steam is injected into the wellbore 11 from a tubing string 15 which goes to the surface. Arrows 16A indicate the direction of flow of steam as it exits the lower end 16 of tubing string 15. As discussed previously, the application of steam via end 16 of tubing 15 is maintained for a relatively short period of time. This lowers the viscosity of the heavy crude and its increased mobility allows it to enter the wellbore 11 via the gravel pack 14 and slotted liner 17. The well is then placed on production until the flow of heavy crude falls too low. Then the cycle is repeated by beginning another application of steam.

Cyclical heating such as described can cause the creation of a desaturated steam zone 13 which becomes largely depleted of movable hydrocarbon. This however, leaves the remainder of the oil sand 12 partially produced and still saturated with heavy viscous crude oil.

Figure 2:
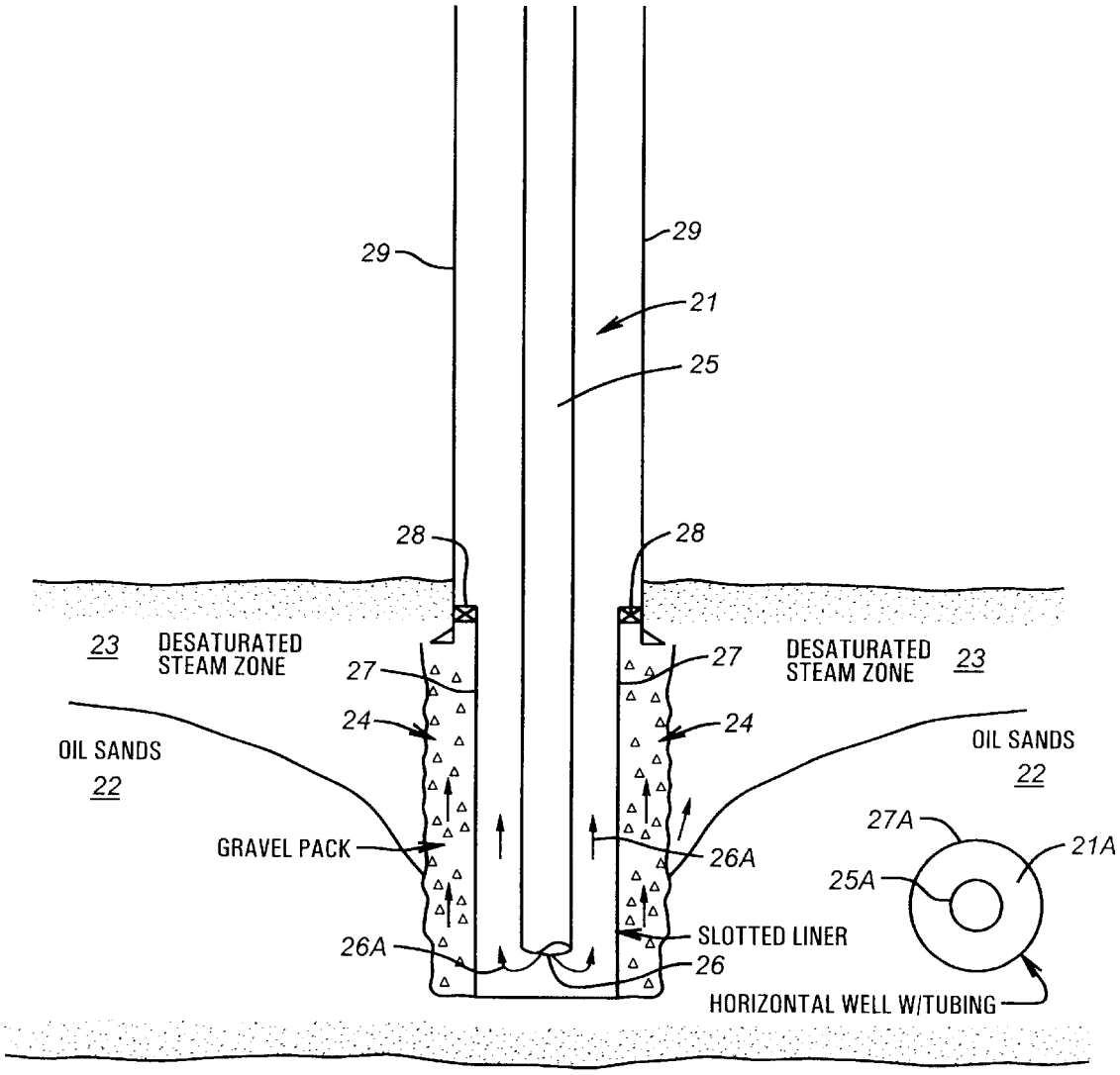
(PRIOR ART) FIG. 2
FIG. 2 is a schematic diagram showing in cross section a vertical well penetrating a heavy crude production zone which is also penetrated by a second, horizontal well.

Referring now to FIG. 2, a wellbore 21 similar to that of FIG. 1 is shown and using the same completion technique with slotted liner 27, gravel pack 24 and tubing string 25. Steam flows as indicated by arrows 26A when applied from the end 26 of tubing string 25, and gradually creates a depletion of hydrocarbon, desaturated steam zone 23 in production formation 22. In this case, however production sand 22 is also penetrated by a horizontal borehole section 21A of a second well. Borehole 21A is lined with a slotted liner 27A and has a tubing string 25A which extends to the surface.

Figure 3:
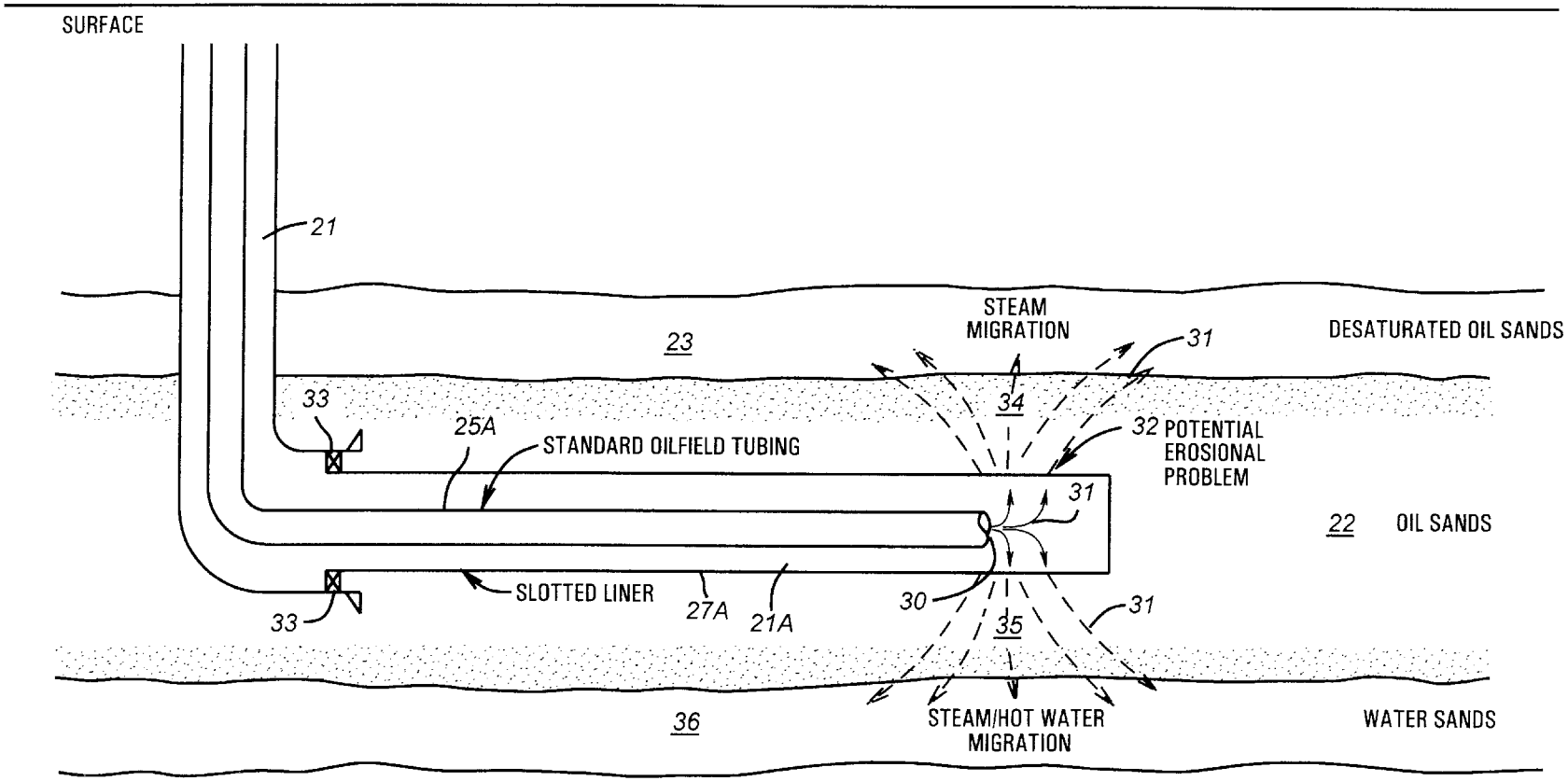
(PRIOR ART) FIG. 3
FIG. 3 is a schematic drawing showing in cross section a prior art steam delivery in a horizontal well in a heavy crude producing zone.

Referring now to FIG. 3 a second cross sectional view shows wellbore 21A (FIG. 2) along a vertical section taken along the axis. Tubing string 25A and slotted liner 27A are as seen at right angles to the view of FIG. 2. The slotted liner is isolated by a lead seal 33 from vertical communication. Live steam is supplied via tubing 25A and exits from its end 30. The steam flow is as indicated by arrows 31. Direct impingement of live steam onto liner 27A at the area numbered 32 can potentially cause erosion and collapse of the liner 27A, an undesirable condition. Also, using this technique the steams' heat is concentrated in areas 34 and 35 of formation 22, although some heating does occur all along the length of the horizontal section of the wellbore 21A. Steam and hot water condensed therefrom tend to migrate via area 35 to lower water sands 36. Steam also tends to move vertically upwardly through region 34 to the desaturated oil sand layer 23 of production sand 22. This configuration is an improvement over that of FIG. 1 alone, however, as the horizontal wellbore 21A tends to heat of more volume of the production zone 22.

Figure 4A:
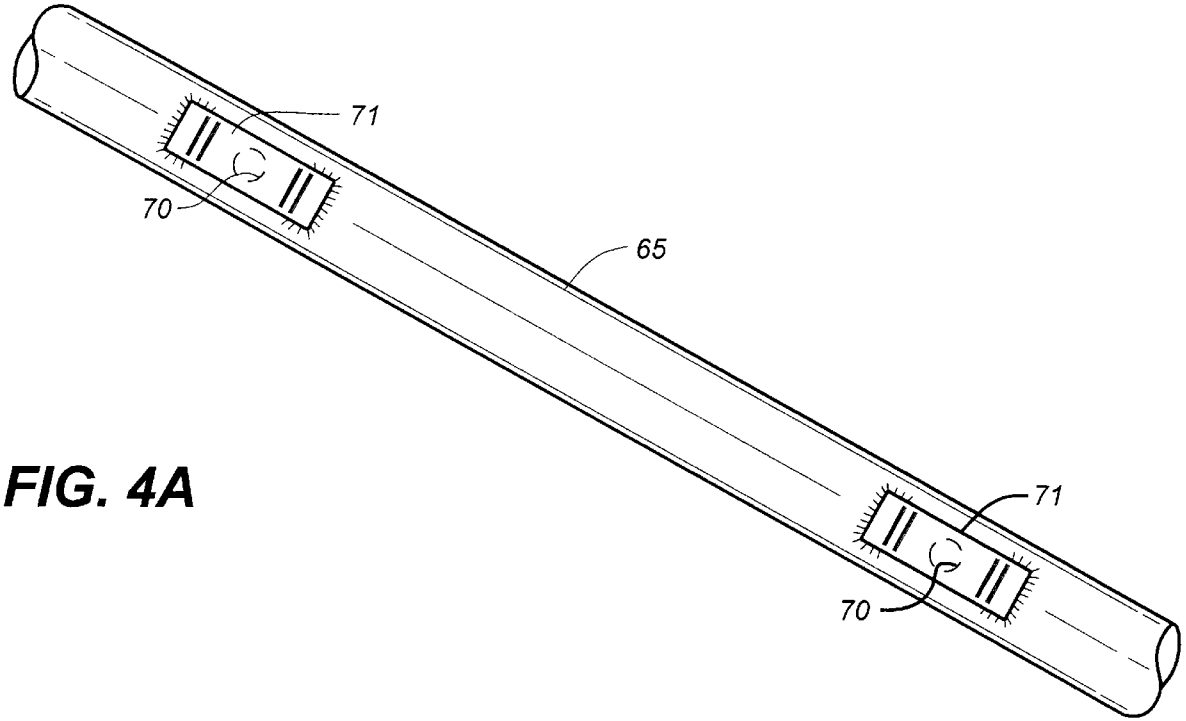
FIG. 4 is a schematic drawing showing the steam stinger apparatus of the present invention in more detail; and, FIG. 5 is a schematic drawing according to concepts of the present invention showing a horizontal well using the steam stinger to uniformly deliver steam along a horizontally drilled well in a heavy crude producing formation.
Figure 4B:
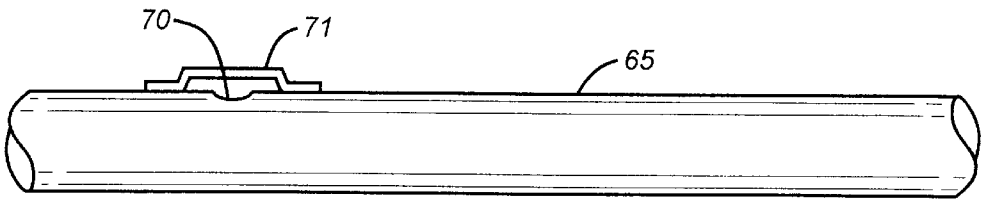
Figure 5:
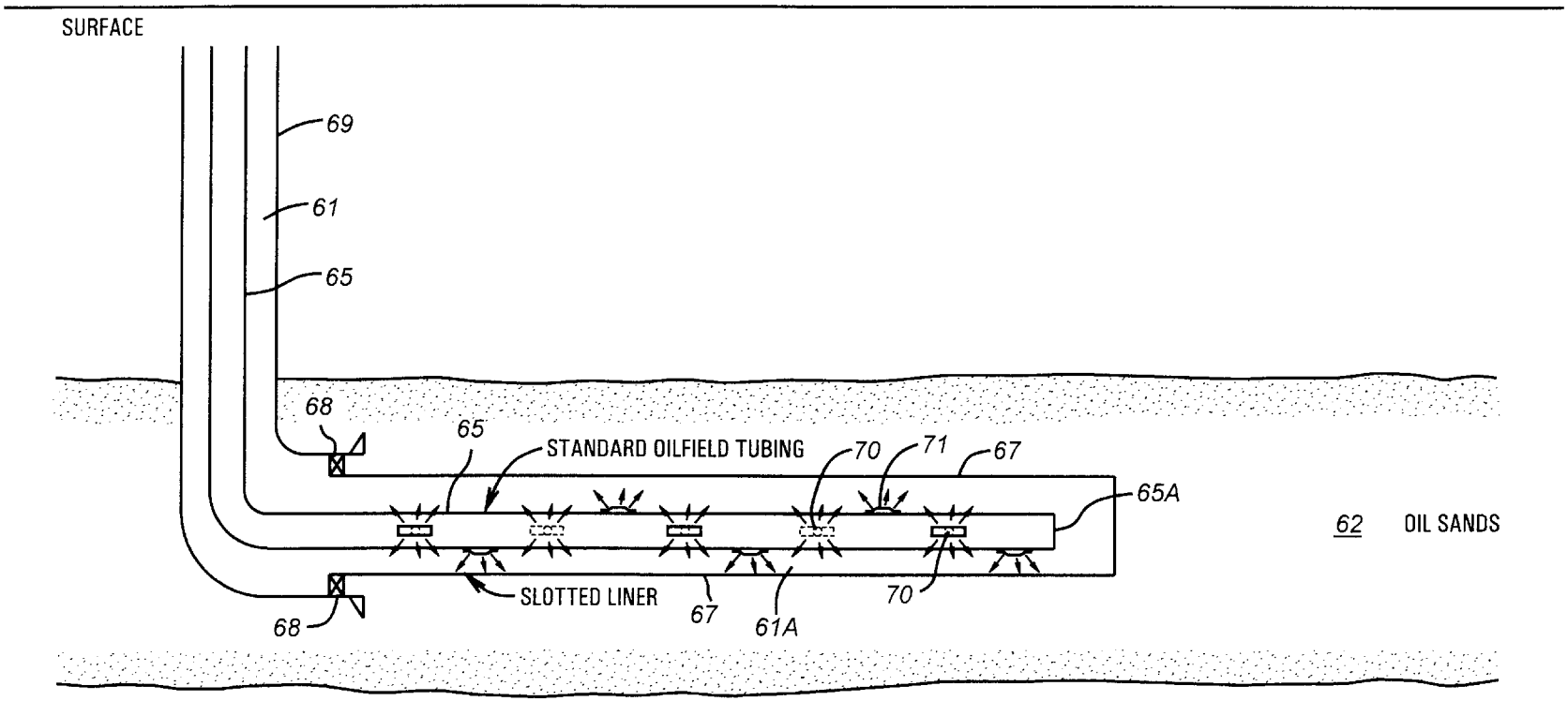

Referring now to FIGS. 4 and 5 the techniques and apparatus according to the concepts of the invention are shown in more detail. A wellbore 61 has a vertical portion which goes to the surface and a horizontal portion 61A which penetrates a long horizontal section of a producing sand 62. A slotted liner lines the horizontal portion 61A of the borehole 61. A tubing string 65 is run in from the surface and, on the lower end thereof is plugged off by a plug 65A. The length of tubing 65 above the plug 65A is provided along its entire horizontal portion with spaced apart drilled holes 70, each of which is covered with a sacrificial impingement strap 71. The straps 71 are of a carbon steel material and may be ceramic coated if desired. The straps 71 are welded to the tubing 65 with an offset above each drilled hole 70 as shown in FIG. 5.

A steam generator source is located at the surface and provides an input of steam into the tubing string 65. The steam travels down the tubing 65 to its lower horizontal portion where it exits via drilled holes 70. The sacrificial impingement straps 71 keep the steam from directly impinging on the slotted liner 67 and thus prevent the possible erosion of the liner 67. Based on experiment and experience it is known that about a rate of 5 barrels of steam per day per foot of horizontal section is desirable. Also about 500 barrels of steam per acre foot is desirable. With these as goals, and knowing the tubing diameter and steam delivery pressure, calculations allow the spacing and size of drilled holes 70 to be made for a particular well. The drilled holes 70 and sacrificial impingement straps 71 are usually symmetrically arranged along the tubing 65 and about its circumference.

In practice a typical field procedure to run steam to a well using this "steam stinger" as described would be as follows.

(1) Pull the existing artificial lift equipment from the well.

(2) Run in on a tubing string the steam stinger designed for this well.

(3) Deliver the steam from the generator to the steam stinger via the tubing string.

(4) Inject steam until the desired volume of steam is injected via the stinger.

(5) Remove the tubing string and steam stinger; and (6) Reinstall the artificial lift equipment into the well and place the well back onto production.

This technique can be cyclically repeated when the produced volume of hydrocarbon fluid falls below an acceptable volume in the manner previously described. The use of the steam stinger as described distributes the heat from the steam evenly along the entire horizontal section of the well borehole. This causes heating of a much larger formation volume than heretofore possible which, of course, leads to attendantly increased mobility and volume of production of the heavy, high viscosity crude oil from the formation.

The foregoing descriptions may make other equivalent embodiments and techniques apparent to those of skill in the art. It is the aim of the appended claims to cover all such changes and modifications that fall within the true spirit and scope of the invention.

We claim:

1. A method for producing heavy viscous crude oil from a production earth formation having a sandstone characteristic and being saturated with heavy viscous crude oil, comprising the steps of:

drilling at least one vertical borehole through said production formation and completion said at least one borehole for hydrocarbon production by lining from said production formation upper boundary to the surface with well casing and through said production formation extent with a slotted production liner and a gravel pack and running production tubing into said liner;

drilling at least one second horizontal borehole penetrating said production formation near the lower boundary of said production formation and completing said borehole for hydrocarbon production by lining from said production formation upper boundary to the surface with well casing and placing a horizontal slotted production liner along the entire horizontal extent of said second horizontal borehole in said production formation and running a second production tubing string into said liner, the end of said production tubing being plugged and the horizontal portion thereof provided with a set of drilled holes sized and placed to distribute stream uniformly along its entire horizontal extent or a desired horizontal portion; and delivery live steam into said second horizontal borehole via said second production tubing substantially uniformly along its entire horizontal extent or a desired horizontal portion without permitting direct live steam delivery onto said production liner and producing hydrocarbon heated by said steam from said vertical borehole.

2. The method of claim 1 and further including the steps of:

repeating said step of delivering live steam into said second horizontal borehole for a predetermined time and then ceasing delivery of said steam and producing hydrocarbon heated by said steam from said vertical borehole and said second horizontal borehole at the same time.

3. The method of claim 2 wherein said steps of delivering steam into said second horizontal borehole substantially uniformly over its entire length or a desired portion and producing hydrocarbon heated by said steam from said vertical borehole and said second horizontal borehole is performed cyclically said production being maintained until the amount of heavy viscous crude falls below a predetermined threshold and then resuming the step of delivering steam for a predetermined length of time or continously.

4. The method of claim 1 wherein the delivery of live steam is performed via a predetermined array of drilled holes in said production tubing, each of said holes being provided with a sacrificial impingement strap.

5. A method for producing heavy viscous crude oil from a production earth formation having a sandstone characteristic and being saturated with heavy viscous crude oil, comprising the steps of:

drilling a well borehole from the surface of the earth vertically to a point above the upper boundary of said production formation and then deviating said borehole in a horizontal direction into and penetrating said production formation horizontally for a predetermined distance;

lining the horizontal extent of said borehole with a production liner over substantially its entire length;

delivering live steam for a predetermined time from the surface of the earth via a tubing string into the horizontal extent of said borehole substantially uniformly along said horizontal extent or a desired portion without live steam impinging directly on said production liner; and producing heavy viscous crude via said tubing string after delivery of steam for said predetermined time has completed.

6. The method of claim 5 wherein the step of delivering steam substantially uniformly along said horizontal extent or a desired portion is performed by use of a steam stinger.

7. The method of claim 6 wherein said steam stinger is provided with a predetermined array of sized drilled holes along its horizontal extent or desired portion, each such hole also being provided with a sacrificial impingement strap to prevent direct steam impingement on said production liner.

* * * * *